US005280977A

United States Patent [19]

Piva

[11] Patent Number: 5,280,977

[45] Date of Patent: Jan. 25, 1994

[54] AUXILIARY DOOR LOCK

[76] Inventor: Lino J. Piva, 240 Kenilworth Avenue North, Hamilton, Ontario, Canada, L8H 4S5

[21] Appl. No.: 67,187

[22] Filed: May 26, 1993

[51] Int. Cl.[5] ..... E05C 19/18

[52] U.S. Cl. ..... 292/296; 292/343

[58] Field of Search ..... 292/295, 296, 298, 292, 292/297, 289, 290, 343

[56] References Cited

U.S. PATENT DOCUMENTS

| | | | |
|---|---|---|---|
| Re. 28,893 | 7/1976 | Adlison, Jr. | 292/292 |
| 227,712 | 5/1880 | Armstrong | 292/297 |
| 568,189 | 9/1896 | Costo | 292/296 |
| 1,043,549 | 11/1912 | Stevenson | 292/292 |
| 2,461,398 | 2/1949 | Sands | 292/297 |
| 4,072,333 | 2/1978 | Hutter, III | 292/292 |
| 4,575,140 | 3/1986 | Dargis | 292/289 X |

*Primary Examiner*—Richard E. Moore

*Attorney, Agent, or Firm*—Rogers & Scott

[57] ABSTRACT

A portable door lock having a base which can be attached to or inserted in a door jamb to extend therefrom into a room to be locked. An arm is attached to the base and is biased to a retracted postion where the door is free to swing open. The arm can be moved against the bias to a postion where the door is blocked from swinging open. A peg is used to lock the arm in this position. Thus, the lock prevents the door from being opened unless the peg is removed and the bias moves the arm back to the retracted postion.

14 Claims, 3 Drawing Sheets

AUXILIARY DOOR LOCK

FIELD OF THE INVENTION

This invention relates to door locks and particularly to an auxiliary door lock which can be used with most doors without affecting an existing lock system or the operation of the door when installed.

BACKGROUND OF THE INVENTION

It is often desirable to be able to lock a door in order to obtain privacy or protection. In some cases, a door may not have a lock installed or a lock which is operable. In other cases, such as where a key lock is installed, the lock may be suspect in its exclusiveness and added security may be desirable.

Portable door locks have been developed to provide privacy and protection in such cases. Prior art door locks are usually securable to a door jamb by hooking a tooth of an elongate base into the aperture present in the striker plate when a door is in an open position. As the door is closed, the door deflects a spring arm attached to the base and biased into the path of the door. When the door has passed the spring arm and is in the closed position, the bias returns the spring arm to its original position in the path of the door thus preventing the door from opening. To open the door, the spring arm is manually deflected out of the path of the door so that the door can be swung open. The lock can then be removed from the striker plate and kept in a pocket or a suitcase.

While this type of prior art lock obtains the necessary end result, there are some difficulties which need to be overcome. The first is that as the door deflects the spring arm, the door can become undesirably marked due to the force of the spring arm upon the door. Further, if the door lock is secured to the door jamb and then the door closed from outside of the room, the room becomes locked with no one to unlock the door and the door or a window may have to be broken to gain access to the room. Also with this type of door lock, it is inconvenient to unlock the door because as the spring arm is being manually deflected from the path of the swinging door, the fingers used for the operation are in a vulnerable position in the path of the opening door. This is especially dangerous if someone were to open the door from the outside.

Therefore, it is among the objects of the invention to provide an improved auxiliary door lock which overcomes the aforementioned difficulties.

SUMMARY OF THE INVENTION

The invention provides an auxiliary door lock comprising a base securable to a door jamb for projecting therefrom into a room to be locked. A locking arm is connected to the base and moveable when the base is secured to the door jamb to a blocking position where a door is prevented from opening and a retracted position where the arm is clear from the door. Biasing means is provided to bias the arm to the retracted position to facilitate closing of the door when the base is secured to the door jamb and locking means is engageable to hold the arm in the blocking position against the biasing means once the door is closed thereby locking the door. The door is unlocked by disengaging the locking means whereby the biasing means returns the arm to the retracted position.

In an embodiment of the invention, the base has a tooth for engagement in an aperture of a striker plate on the door jamb for securing the base to the door jamb. The tooth may be punched from the base and bent to leave an aperture in the base corresponding with an aperture in the striker plate. In another embodiment, the base may have at least one hole through which fastening means may be passed to secure the base to the door jamb.

The base may comprise a flat plate which extends from the door jamb substantially perpendicular to the door when the door is closed. The arm of the base may be made from a first arm portion which is punched from the base and remains fastened to the base at an end of the arm remote from the door jamb. The biasing means may be resident in this first arm portion. The arm may further comprise a second arm portion which defines a seat for the locking means. The second arm portion may extend outwardly from the base when the arm is in retracted position and is preferably wider than the first arm portion so that the second arm portion cannot pass through the base. The second arm portion may be spot welded to the base and the first arm portion.

In a preferred embodiment, the locking means is a peg which is engageable between the arm and the base when the arm is in the blocking position. The arm defines a seat for the peg. Preferably, the peg is wedge shaped and is tethered to the base.

BRIEF DESCRIPTION OF THE DRAWINGS

Two embodiments will be described, by way of example, with reference to the accompanying drawings, of which.

DETAILED DESCRIPTION OF TWO EMBODIMENTS OF THE INVENTION

Figure 1:
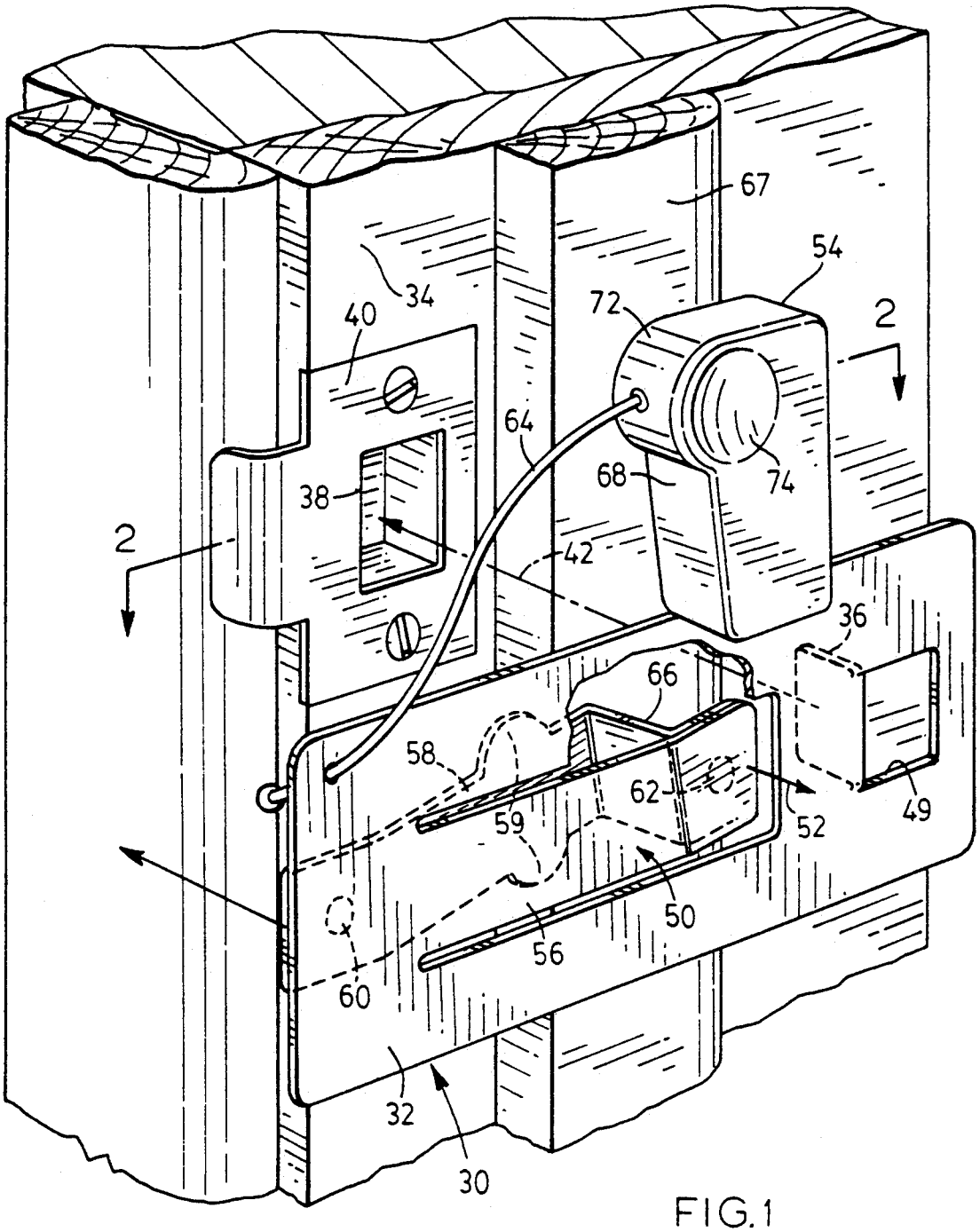
FIG. 1 is a simplified perspective view of an auxiliary door lock according to a first embodiment of the invention.
Figure 2:
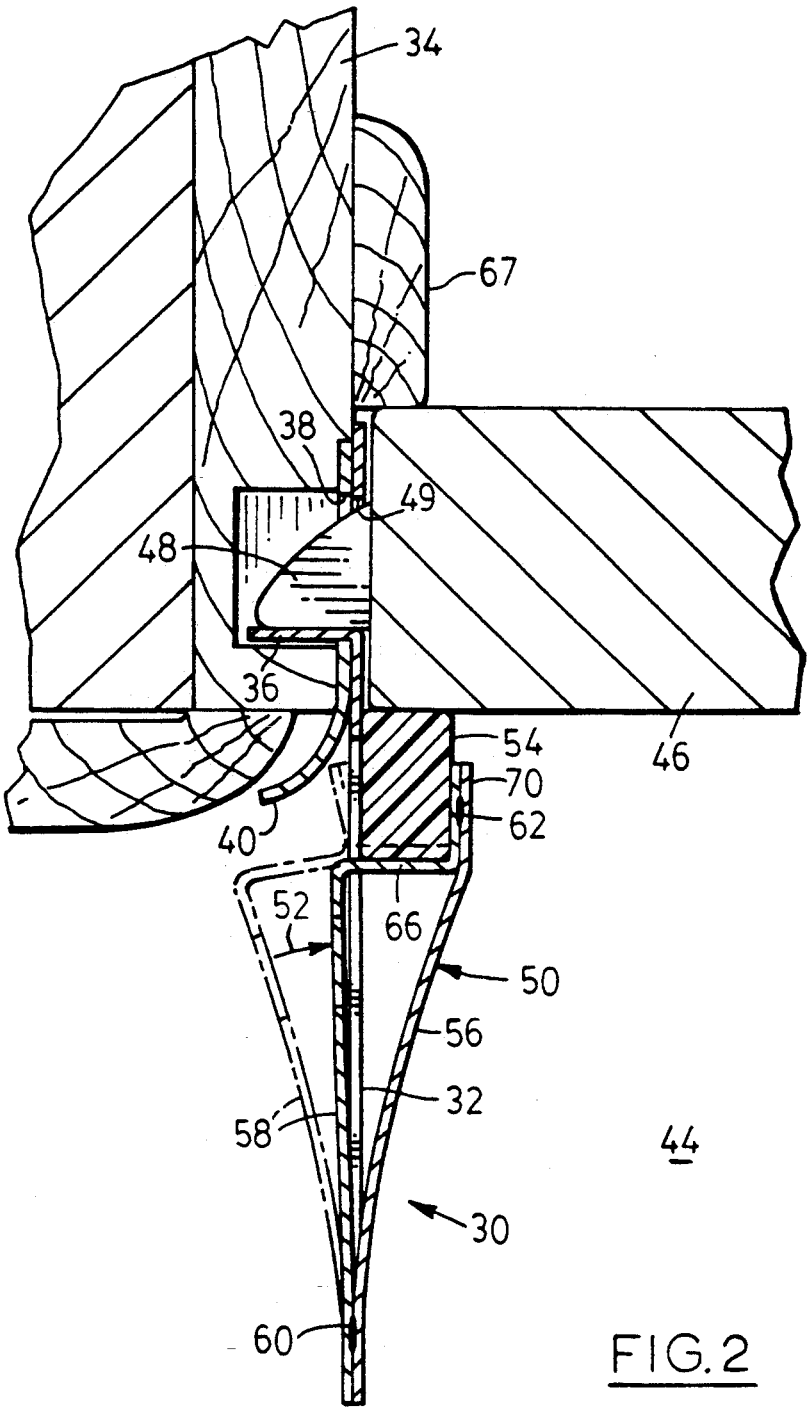
FIG. 2 is a sectional view on line 2—2 of FIG. 1 showing the auxiliary door lock in plan and installed in a door jamb with the door in a locked position.

Referring to FIG. 1, an auxiliary door lock 30 is illustrated and has a base 32 securable to a door jamb 34 by inserting a tooth 36 into an aperture 38 in a striker plate 40 following arrow 42. Once the base 32 is secured to the door jamb 34 as shown in FIG. 2, the base 32 extends from the door jamb 34 perpendicularly to a door 46 into a room 44 to be locked. The door 46 of the room 44 can then be closed to a position as shown in FIG. 2 where a spring-bolt 48 passes through an aperture 49 in the base 32 and the aperture 38 in the striker plate 40 to sit ahead of the tooth 36.

To lock the door 46, a locking arm 50 connected to the base 32 is moved against a bias inherent in the arm 50 so that the arm 50 is deflected from a retracted position shown in chain dotted line in FIG. 2 to a blocking position following arrow 52 where the door 46 is prevented from opening. This movement is carried out by one hand of an individual while the second hand of the individual inserts a peg 54 between the arm 50 and the base 32 to hold the arm 50 in the blocking position against the bias.

The arm 50 is formed from a first arm portion 56 which is punched from the base 32 and remains fastened to the base 32 at an end of the arm 50 remote from the door jamb 34 and a second arm portion 58 which is spot welded at welds 60 and 62 to the base 32 and first arm portion 56 respectively. In this embodiment the second arm portion 58 extends outwardly from the base 32 when the arm 50 is in the retracted postion, and lies flush with the base 32 when the arm 50 is in the blocking position, as shown in FIG. 2. The second arm portion 58 is wider at area 59 than the punched portion of the base 32 so that the second arm portion 58 cannot pass through the base 32 and the angular motion of the arm 50 in the direction of arrow 52 is limited.

As shown in FIG. 1 the peg 54 is tethered to the base 32 with a tether 64 and can be positioned in a seat 66 formed by the second arm portion 58 when the arm 50 is in the blocking postion as shown in FIG. 2. It should be noted that the peg 54 has a sloped side 68 which gives the peg 54 a wedge shape. The seat 66 has a corresponding slope so when the peg 54 is positioned in the seat 66, the wedge shape will cause the peg 54 to closely abut the door 46. Thus, a variety of doors having various widths or positioning of apertures in striker plates is accomodated. Further, door rattling and drafts are reduced because the door 46 is pressed against a stop 67 by the wedge shape of the peg 54.

The peg 54 is held in place laterally by joined portion 70 of the first portion 56 and second portion 58 of the arm 50. It should be noted that the joined portion 70 and the seat 66 are substantially perpendicular to one another and the joined portion 70 forms an obtuse angle with the first portion of the arm 56 so that when the arm 50 is moved to the blocking position, the joined portion 70 is substantially parallel with the base 32. In this position, the door 46 becomes blocked by the peg 54 in the seat 66 held by the arm 50 attached to the base 32 secured in the aperture 38 of the striker plate 40 by the tooth 36.

The peg 54 has a grip portion 72 defining a depression 74 which the fingers can easily grasp when engaging and disengaging the peg 54 in and from the seat 66. The grip portion 72 also prevents the peg 54 from falling through the seat 66 if the distance from the seat 66 to the door 46 is wider than the wedge shape of the peg 54.

To unlock the door, the peg 54 is disengaged from the seat 66 by pulling the grip portion 72 upwardly. The bias resident in the arm 50 then returns the arm 50 to the retracted position as shown in FIG. 1 and in chain dotted line in FIG. 2. At this point, a door handle (not shown) can be turned to retract the spring-bolt 48 from the apertures 38, 49 and the door 46 is clear to be opened. Finally, the lock 30 can be removed from the door jamb 34 and carried conveniently in a pocket or a suitcase.

The bias which biases the arm 50 to the retracted position may be resident in the material of the first arm portion 56 and/or the second arm portion 58.

Figure 3:
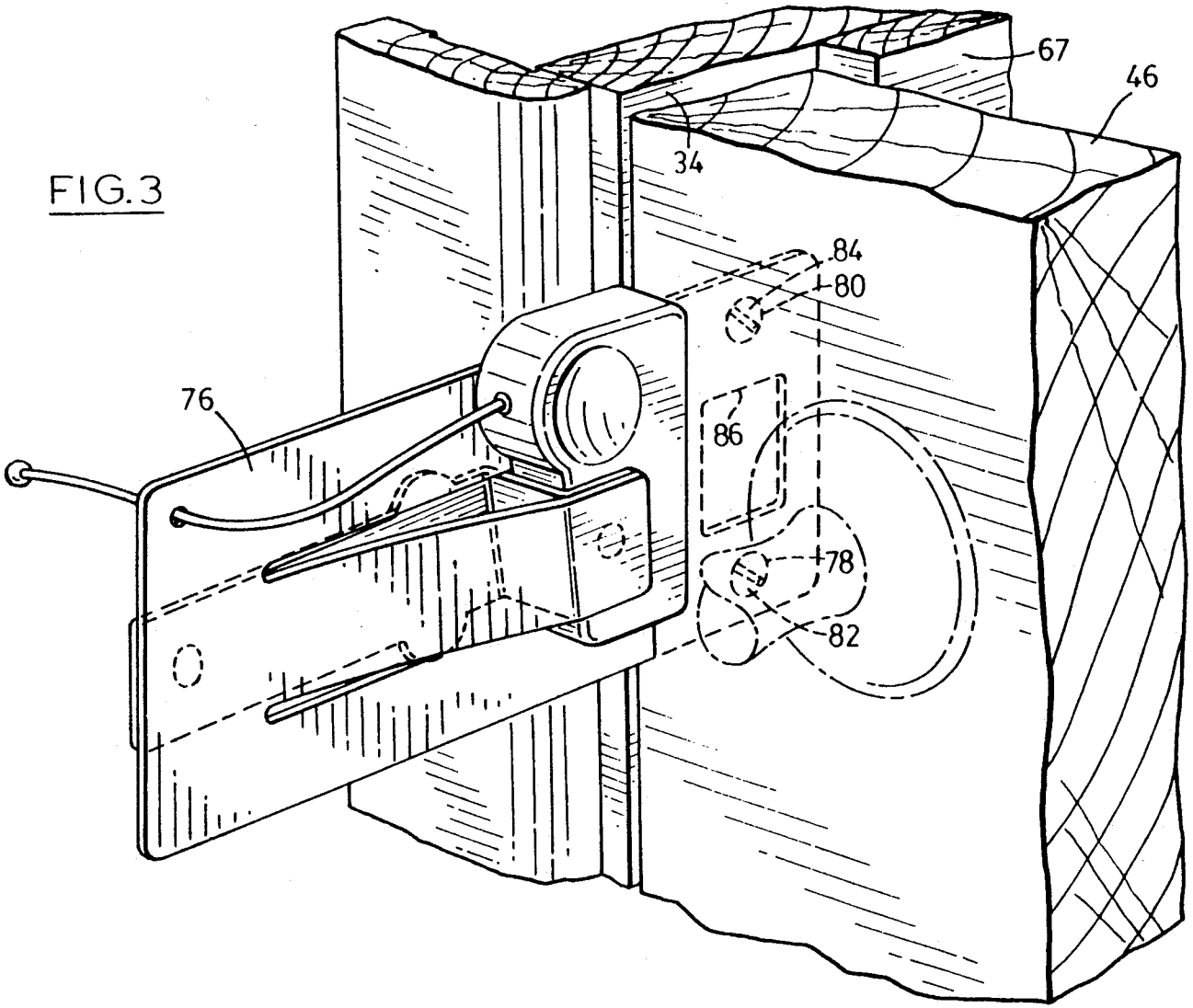
FIG. 3 is a simplified perspective view of a second embodiment of the invention installed in a door lock with the door in a locked position.

A second embodiment of the invention is shown in FIG. 3, the difference being that a base 76 has two holes 78, 80 through which screws 82, 84 can pass to fasten the base 76 to the door jamb 34 permanently. There is an aperture 86 in the base 76 corresponding to the aperture 38 and through which the spring-bolt 48 can pass. It should be noted that, in this embodiment, there is no need for a tooth such as the tooth 36 in the previous embodiment. Further, the base 76 can be secured anywhere along the door jamb 34 not just at the stiker plate 40.

The door lock 30 will not mark the door 46 because the base 32 and the arm 50 are clear from the door 46 as it swings from an open to closed position and vise-versa.

If it is desirable to reduce the bias in the arm 50 so that is easier to deflect the arm from the retracted position to the blocking position, one of the arm portions 56,58 can be hinged and the other can provide the spring bias. Both arm portions 56, 58 however will still provide support against someone trying to open the door 46 when the arm 50 is in the blocking position. If the material of the lock 30 is strong enough, one arm portion can be used. In this case, structural support for the seat 66 may be required. The lock 30 can be reinforced by providing raised structural grooves along portions of the base 32 and the arm 50. Other embodiments will be apparent to a person skilled in the art, the scope of the invention being defined in the appended claims.

I claim:

1. An auxiliary door lock comprising:

a base securable to a door jamb for projecting therefrom into a room to be locked;

a locking arm connected to the base and moveable when the base is secured to said door jamb to a blocking position where a door is prevented from opening and a retracted position where the arm is clear from said door;

biasing means to bias the arm to said retracted position to facilitate closing of said door when the base is secured to said door jamb; and locking means engageable to hold the arm in said blocking position against the biasing means once said door is closed thereby locking said door, said door being unlocked by disengaging the locking means whereby the biasing means returns the arm to said retracted position.

2. An auxiliary door lock as claimed in claim 1 wherein the base has a tooth for engagement in an aperture of a striker plate on said door jamb for securement of the base to said door jamb.

3. An auxiliary door lock as claimed in claim 2 wherein said tooth is punched from the base and bent to leave an aperture in the base corresponding with said aperture in said striker plate.

4. An auxiliary door lock as claimed in claim 1 wherein said base has at least one hole through which fastening means can be passed to secure the base to said door jamb.

5. An auxiliary door lock as claimed in claim 1 wherein the base extends from said door jamb substantially perpendicularly to said door when said door is closed.

6. An auxiliary door lock as claimed in claim 5 wherein the arm has a first arm portion punched from the base, said first arm portion remaining fastened to the base at an end of the arm remote from said door jamb, the biasing means being resident in the material of said first arm portion.

7. An auxiliary door lock as claimed in claim 6 wherein the arm further comprises a second arm portion which extends outwardly from the base clear from said door when the arm is in said retracted position.

8. An auxiliary door lock as claimed in claim 7 wherein said second arm portion is wider than said first arm portion, so that said second arm portion cannot pass through the base.

9. An auxiliary door lock as claimed in claim 7 wherein said second arm portion is fastened to the base and said first arm portion and wherein the biasing means is resident in the material of said second arm portion.

10. An auxiliary door lock as claimed in claim 1 wherein the arm defines a seat for said locking means.

11. An auxiliary door lock as claimed in claim 1 wherein the locking means comprises a peg which is engageable between the arm and the base when the arm is in said blocking position.

12. An auxiliary door lock as claimed in claim 11 wherein said peg has a wedge shape.

13. An auxiliary door lock as claimed in claim 12 wherein the arm defines a seat shaped to receive said wedge shape of said peg.

14. An auxiliary door lock as claimed in claim 11 wherein said peg is tethered to the base.

* * * * *